US005374465A

United States Patent [19]

Fulcomer

[11] Patent Number: 5,374,465

[45] Date of Patent: Dec. 20, 1994

[54] ECONOMICAL ROADWAY MARKING SHEETING MATRIX

[75] Inventor: Robert D. Fulcomer, Greenville, R.I.

[73] Assignee: Plymouth Rubber Company, Canton, Mass.

[21] Appl. No.: 116,128

[22] Filed: Sep. 2, 1993

[51] Int. Cl.[5] ..... B32B 9/00

[52] U.S. Cl. ..... 428/122; 428/143; 428/212; 428/217; 428/283; 428/286; 428/323; 428/327; 428/339; 427/137; 404/12; 404/17; 156/71

[58] Field of Search ..... 428/143, 149, 150, 172, 428/212, 220, 323, 327, 328, 331, 337, 339, 406, 429, 413, 217, 283, 286; 427/137; 404/12, 117; 156/71

[56] References Cited

U.S. PATENT DOCUMENTS

| | | | |
|---|---|---|---|
| 4,069,281 | 1/1978 | Eigenmann | 264/1 |
| 4,117,192 | 9/1978 | Jorgensen | 428/337 |
| 4,282,281 | 8/1981 | Ethan | 428/149 |
| 4,299,874 | 11/1981 | Jones et al. | 428/143 |
| 4,388,359 | 6/1983 | Ethan et al. | 428/143 |
| 4,438,228 | 3/1984 | Schenck | 428/96 |
| 4,490,432 | 12/1984 | Jordan | 428/220 |
| 4,876,141 | 10/1989 | Kobayashi et al. | 428/217 |
| 4,993,868 | 2/1991 | Eigenmann | 404/12 |
| 5,094,902 | 3/1992 | Haenggi et al. | 428/150 |
| 5,139,590 | 8/1992 | Wyckoff | 404/14 |

*Primary Examiner*—Patrick J. Ryan
*Assistant Examiner*—Abraham Bahta
*Attorney, Agent, or Firm*—Weingarten, Schurgin, Gagnebin & Hayes

[57] ABSTRACT

An economical roadway marking sheeting matrix that includes hydrated alumina as its main inorganic filler is disclosed. Use of hydrated alumina in the roadway marking sheeting matrix results in reduced mixing and production time, reduction of aging time, lower transportation cost due to lower weight, and lower material cost. In a preferred embodiment, hydrated alumina having a particle size of less that one micron and a GE brightness of 94 or more is incorporated as the main filler system in a roadway marking sheeting matrix. The resulting sheeting matrix may then be fabricated into a road marker by bonding to an upper layer which may include glass beads, and to an adhesive layer for attachment to a road surface.

25 Claims, 1 Drawing Sheet

ECONOMICAL ROADWAY MARKING SHEETING MATRIX

FIELD OF THE INVENTION

This invention relates to roadway marking materials, and in particular to a formulation of a roadway marking sheeting matrix that includes hydrated alumina as a major filler.

BACKGROUND OF THE INVENTION

Road surfaces and other paved areas often must be marked to indicate various traffic control information, such as lane boundaries and striping, stop bars, and pedestrian lane markings at intersections and crosswalks. Many compounds have been devised to provide a long-lasting, highly visible road markings and include materials such as paint, plastic, and rubber formulations. However, each of these materials has its own deficiencies when used in traffic-intensive areas.

Painted road markings provide an suitable choice in many traffic situations. Unfortunately, painted markings wear out quickly in highly trafficked areas, such as travel lanes or at intersections. Painted markings are also drastically affected by cold weather road treatments, such as salt, sand, or gravel. In addition, snow plows and studded tires used in cold climates quickly wear the road marking paint from the road surface. As a result, painted road markings must generally be reapplied after each winter.

Preformed plastic road marking strips face the problem of satisfactory adherence to the road surface under constant heavy motor vehicle traffic. Unless; the pavement marker has a deformable layer of elastomeric materials which lacks memory positioned between the marker and the road surface, good adhesion will not always be achieved. Moreover, the constant flow of motor vehicle traffic on the stiff plastic marker can result in cracking and/or fractures. As a result, dirt may accumulate between the adhesive and the road surface and ultimately destroy the adhesive properties holding the plastic marking strip on the road surface.

Pavement marking sheet material made from unvulcanized elastomer precursors provide traffic control markings of superior durability over the plastic type because of greater deformability and reduced elasticity. Such sheet material is semi-rigid, exhibits very little rebound, and is able to flow over a broad temperature range. The materials deforms readily into intimate contact with the irregular pavement surface and absorbs the energy of wheel impacts without fracture. Further, the low elasticity of the precursor avoids the stretch-return action that has been found to loosen sheet material from a roadway.

Use of the elastomer materials has grown rapidly in recent years because they provide long life in heavy wear locations when compared to simple painted lines or plastic markings. Typically, preformed elastomer pavement marking materials comprise a continuous, wear-resistant top layer overlying a flexible base sheet, and are applied to substrates using pressure sensitive adhesive or contact cement. Typical formulations of elastomer-based pavement marking sheeting, such as disclosed in U.S. Pat. Nos. 4,117,192 to Jorgensen, include an acrylonitrile-butadiene elastomer polymer, a chlorinated paraffin extender resin, asbestos fiber filler, stearic acid, glass microspheres, silica or silica derivatives, and titanium dioxide.

Acrylonitrile-butadiene is the major polymer in the mixture and is preferred because it offers a high degree of oil resistance. An extender resin, such as a halogenated paraffin which is soluble in the polymer mixture is also included. Fillers, such as asbestos fibers, add reinforcement, surface hardness, and abrasion resistance properties to the final product. Glass microspheres are also included in the material to provide reflectivity at night and to give the sheet material skid-resistant qualities.

The above-described formulation of sheet material is deficient for some uses because asbestos fibers can constitute a large proportion of the inorganic filler in the sheet material. Asbestos fibers contribute importantly to the desired properties of the sheet material, but for toxicity reasons, use of such fibers has been virtually eliminated for many applications. Alternative fillers, such as polyethylene fibers as disclosed in U.S. Pat. No. 4,490,432 to Jordan, or reinforcing cellulose fibers, as disclosed in U.S. Pat. No. 5,139,590 to Wyckoff may substitute for asbestos filling material.

Although improvements have been made to the polymer component of the material (e.g., U.S. Pat. No. 5,077,117 to Harper and U.S. Pat. No. 4,282,281 to Ethen), most formulations of pavement marking materials continue to use titanium dioxide ($TiO_2$) as an additional main filling component. The titanium dioxide also functions as a pigment to impart a white color, opacity, and brightness to the formulation. However, several deficiencies arise from the use of titanium dioxide in the above formulation. Titanium dioxide is an expensive material, generally costing between $1-1.50 per pound. Use of titanium dioxide can therefore account for a large portion of the cost of the road marking material. Titanium dioxide is also a heavy material and when utilized in a road marking formulation provides for difficult handling of the product and increased transportation cost. Titanium dioxide is also not completely compatible with many of the polymers and fillers in the formulations of the prior art. Long mixing times are frequently required to combine the titanium dioxide filler with the other ingredients in the formulation. The lack of compatibility also necessitates a long aging period between mixing and calendaring.

SUMMARY OF THE INVENTION

An economical roadway marking sheeting matrix that includes hydrated alumina as its main inorganic filler is disclosed. Use of hydrated alumina in the roadway marking sheeting matrix results in reduced mixing and production time, reduction of aging time, lower transportation cost due to lower weight, and lower material cost. In a preferred embodiment, hydrated alumina having a particle size of less that one micron and a GE brightness of 94 or more is incorporated as the main filler system in a roadway marking sheeting matrix. The resulting sheeting matrix may then be fabricated into a road marker by bonding to an upper layer which may include glass beads, and to an adhesive layer for attachment to a road surface.

The present invention provides a new formulation of roadway marking material that is mechanically strong, economical, and provides faster and easier production using existing equipment. According to the invention, hydrated alumina filler is employed as a major filler in the roadway marking sheeting matrix, and offers many advantages over fillers used in the prior art. Hydrated alumina provides many advantages over the titanium dioxide fillers including lower cost, reduced mixing time, shorter aging period between mixing and calendaring, and lower transportation cost through lower weight.

The matrix is subsequently processed to fabricate the roadway marker which typically is in strip form. The sheeting matrix is laminated to an upper surface of polyurethane which typically includes glass beads for visibility. An adhesive layer is applied to the lower surface of the sheeting, then the upper layer is applied, together with a release sheet if necessary, and the sheeting is then slit into intended widths and rolled to provide marker strips which can be cut from the roll and applied to a roadway surface.

DESCRIPTION OF THE DRAWING

The invention will be more fully understood from the following detailed description taken in conjunction with the accompanying drawing in which.

DETAILED DESCRIPTION OF THE INVENTION

Figure 1:
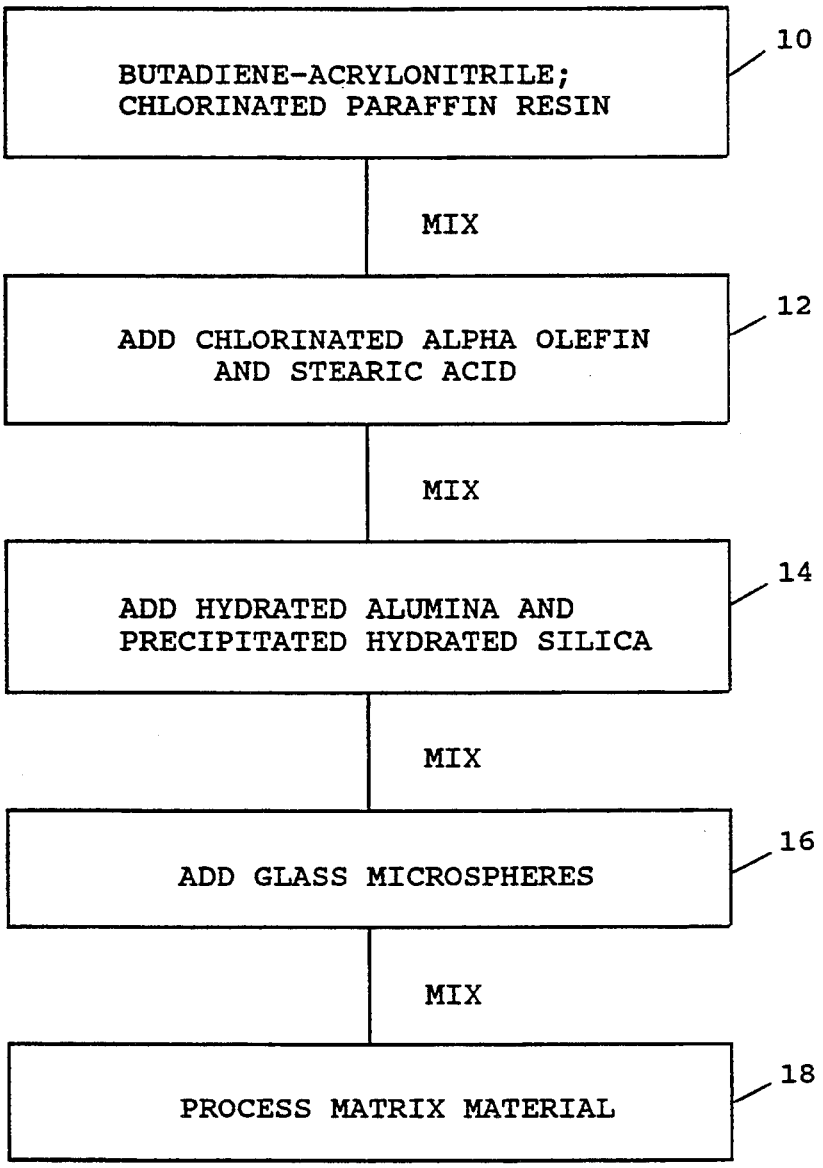
FIG. 1 is a block diagram illustrating steps in the production of the invention.

FIG. 1 shows the steps in the manufacturing of the roadway marking sheeting matrix of the present invention. As shown at 10, butadiene-acrylonitrile elastomer polymer is first mixed with chlorinated paraffin resin. The butadiene-acrylonitrile polymer provides the resulting matrix with a viscoelastic character, and permits absorption of forces and pressures of road traffic without creating internal forces that tend to loosen the matrix from the roadway. Butadiene-acrylonitrile polymers are preferred starting materials because they offer a high degree of oil resistance. An extender resin, such as chlorinated paraffin resin shown at step 10, is included with the elastomer, and is miscible with or forms a single phase with the elastomer component. In a preferred embodiment, 13–15 parts by weight butadiene-acrylonitrile polymer and 6–12 parts by weight chlorinated paraffin resin are used. The elastomer component preferably accounts for at least 50% of the polymeric ingredients in the composition.

As shown at step 12 in FIG. 1, chlorinated alpha-olefin and stearic acid are next added to the mixture. Chlorinated alpha-olefin acts as a plasticizer during the mixing operation, and lowers the energy required to complete the mixing. In addition, the olefin adds flexibility to the finished product, and allows the product to be used in low temperature environments. In a preferred embodiment, 0–6 parts by weight of chlorinated alpha-olefin in a 60% (by weight) chlorine liquid, and 0–1 part by weight of stearic acid, rubber grade are preferred.

Fillers are generally included in the composition to add other properties such as reinforcement, extending, surface hardness, and abrasion resistance. Fillers such as amorphous precipitated hydrated silica and silica derivatives are preferred because they have been found to give the best abrasion resistance and downweb strength properties.

As shown in FIG. 1 at step 14, hydrated silica filler is added to the mixture along with a hydrated alumina filler. Hydrated alumina typically is used in flame retardant materials for combustion control and smoke suppression. However, it has been unexpectedly found that hydrated alumina may be a useful and economical filler in roadway marking materials.

As employed in the present invention, hydrated alumina filler offers several important production advantages over titanium dioxide. Hydrated alumina is generally one-half to one-third the cost of titanium dioxide, and its use can significantly reduce the cost of roadway marking material. Hydrated alumina disperses in an intensive mixer much more rapidly than titanium dioxide, thereby reducing mixing time by as much as 50%. Further, hydrated alumina has a different surface activity compared to titanium dioxide, and therefore combines more rapidly with the polymers and plasticizers in the formulation, thereby reducing the necessary aging period between mixing and calendaring. Finally, hydrated alumina has a specific gravity of 2.4 as compared to 4.1 for titanium dioxide. This difference results in a finished product of reduced weight, allowing for easier handling and lower transportation costs.

In a preferred embodiment, 1–4 parts by weight of amorphous precipitated hydrated silica and 25–40 parts by weight of hydrated alumina are employed in the invention. Preferably, the hydrated alumina particles have a diameter of less than one micron, and typically in the range of 0.2–0.7 microns. The hydrated alumina also preferably has a GE brightness of at least 94.

As shown in FIG. 1 at step 16, transparent microspheres and skid-resistant particles are also generally included in the material of the invention to provide reflectivity at night and to give the material skid-resistant qualities. Alternatively, an exterior layer of such particles may be provided on the top of the sheet material, partially embedded in the sheet material and partially protruding from the sheet material, to provide immediate reflectivity and skid-resistance. In a preferred embodiment, 35–50 parts by weight of solid glass spheres with a 115 micron mean diameter are used.

After mixing, as shown at step 18 of FIG. 1, the components are processed on calendaring rolls where they form a smooth band and are processed into thin sheets of the desired thickness. Generally, sheets are formed having a thickness of at least about 20 mils and preferably at least about 30 mils, but generally the sheets are less than about 60 mils thick. The resulting sheet matrix is then processed into a final road marker. Typically, the sheet matrix is laminated to an upper surface, and a pressure sensitive adhesive layer is applied to the lower surface. The adhesive layer generally includes an acrylic or acrylic derivative. The sheet is then slit into strips of intended width and the strips are rolled into an intended length. A release coating may be employed if necessary on the outer surface of the top layer to prevent sticking when the strip is rolled.

EXAMPLE

The commercially available ingredients shown in Table I were mixed in an internal mixer, such as a Banbury mixer, where they reached a temperature of approximately 130° C. The material was then cooled and calendared into a sheet about 1 mm thick.

TABLE I

Materials of an exemplary formulation.

| MATERIAL | PARTS BY WEIGHT |
|---|---|
| Butadiene-Acrylonitrile (Cold polymerized, medium high acrylonitrile copolymer) | 14 |

TABLE I-continued

Materials of an exemplary formulation.

| MATERIAL | PARTS BY WEIGHT |
|---|---|
| Chlorinated Paraffin Resin (70% chlorine, softening point 100° C.) | 8 |
| Chlorinated Alpha-Olefin (60% by weight chlorine liquid) | 3.5 |
| Stearic Acid (Rubber Stock) | 0.5 |
| Solid Glass spheres (115 μm mean diameter) | 41 |
| Precipitated Hydrated Silica, Amorphous | 2 |
| Hydrated Alumina (Mean diameter < 1 μm; GE brightness ≧ 94) | 31 |

The resulting matrix had the following physical properties:

TABLE II

Test results of exemplary formulation.

| | |
|---|---|
| Tensile strength | approximately 3 MPa |
| Elongation | approximately 90% |
| Hardness | approximately 55 Shore A |

Although a butadiene-acrylonitrile polymer is described as a useful polymer, it should be appreciated that other polymers such as neoprene, polyacrylates, styrene-butadiene, or the like, either alone or in combination with other nitrile-containing compounds, may also be used as an elastomeric component.

While the illustrated resin extender described herein is a chlorinated paraffin resin, it will be appreciated that alternative resins can be used as an extender, such as halogenated polymers, polystyrenes or the like. Further, while the fillers described with respect to the illustrative embodiment herein includes silica, one of ordinary skill in the art will appreciate that alternative fillers, such as talc or magnesium silicate of the needle-type or bead-type, may be included instead of or in addition to the silica filler described herein.

Although the invention has been shown and described with respect to an illustrative embodiment thereof, it should be appreciated that the foregoing and various other changes, omissions and additions in the form and detail thereof may be made without departing from the spirit and scope of the invention as delineated in the claims.

What is claimed is:

1. A roadway marking sheeting matrix comprising:

an elastomer polymer selected from the group consisting of butadiene-acrylonitrile, neoprene, polyacrylate, and styrene-butadiene;

an extender resin selected from the group consisting of chlorinated paraffin resin, halogenated polymers, and polystyrenes; and at least 25 and substantially no more than 40 parts by weight of hydrated alumina.

2. The roadway marking sheeting matrix of claim 1, wherein said hydrated alumina is less than one micron in diameter.

3. The roadway marking sheeting matrix of claim 1, wherein said elastomer polymer comprises at least 13 and substantially no more than 15 parts by weight of butadiene-acrylonitrile.

4. The roadway marking sheeting matrix of claim 1, wherein said extender resin comprises at least 6 and substantially no more than 12 parts by weight of chlorinated paraffin resin.

5. The roadway marking sheeting matrix of claim 1, further comprising a plasticizer.

6. The roadway marking sheeting matrix of claim 5, wherein said plasticizer includes chlorinated alpha-olefin.

7. The roadway marking sheeting matrix of claim 6, wherein said chlorinated alpha-olefin comprises substantially no more than 6 parts by weight.

8. The roadway marking sheeting matrix of claim 1, further comprising substantially no more than 1 part by weight of stearic acid.

9. The roadway marking sheeting matrix of claim 1, further comprising hydrated silica.

10. The roadway marking sheeting matrix of claim 9, wherein said hydrated silica comprises at least 1 and substantially no more than 4 parts by weight.

11. The roadway marking sheeting matrix of claim 1, wherein said solid glass spheres comprise substantially no more than 50 parts by weight and have a mean diameter of approximately 115 microns.

12. A roadway marking sheeting matrix comprising:

butadiene-acrylonitrile elastomer polymer, said polymer comprising 13 to 13 parts by weight of said matrix;

chlorinated paraffin extender resin, said resin comprising 6 to 12 parts by weight of said matrix;

chlorinated alpha-olefin plasticizer, said plasticizer comprising 0–6 parts by weight of said matrix;

stearic acid rubber stock, said stearic acid comprising 0 to 1 part by weight of said matrix;

solid glass spheres, said spheres having a mean diameter of approximately 115 microns and comprising 35 to 50 parts by weight of said matrix;

amorphous precipitated hydrated silica, said silica comprising 1 to 4 parts by weight of said matrix; and hydrated alumina, said alumina having a mean diameter of less than one micron and a GE brightness of at least 94, said alumina comprising 25 to 40 parts by weight of said matrix.

13. A roadway marker comprising:

a matrix sheet having an elastomer polymer selected from the group consisting of butadiene-acrylonitrile, neoprene, polyacrylate, and styrene-butadiene, an extender resin selected from the group consisting of chlorinated paraffin resin halogenated polymers, and polystyrenes, and at least 25 and substantially no more than 40 parts by weight of hydrated alumina;

an upper layer laminated to one surface of said matrix sheet and having predetermined visibility characteristics; and an adhesive layer applied to the opposite surface of said matrix sheet and operative to bond to a roadway surface.

14. The roadway marker of claim 13, wherein said hydrated alumina is less than one micron in diameter.

15. The roadway marker of claim 13, wherein said elastomer polymer comprises at least 13 and substantially no more than 15 parts by weight of butadiene-acrylonitrile.

16. The roadway marker of claim 13, wherein said extender resin comprises at least 6 and substantially no more than 12 parts by weight of chlorinated paraffin resin.

17. The roadway marker of claim 13, wherein said matrix further comprises a plasticizer.

18. The roadway marker of claim 17, wherein said plasticizer includes chlorinated alpha-olefin.

19. The roadway marker of claim 18, wherein said chlorinated alpha-olefin comprises substantially no more than 6 parts by weight.

20. The roadway marker of claim 13, wherein said matrix further comprises substantially no more than 1 parts by weight of stearic acid.

21. The roadway marker of claim 13, wherein said matrix further comprises hydrated silica.

22. The roadway marker of claim 21, wherein said hydrated silica comprises at least 1 and substantially no more than 4 parts by weight.

23. The roadway marker of claim 13, wherein said upper layer includes solid glass spheres, said spheres comprising substantially no more than 50 parts by weight and have a mean diameter of approximately 115 microns.

24. The roadway marker of claim 13, wherein said upper layer includes polyurethane.

25. A roadway marking sheeting matrix comprising:

butadiene-acrylonitrile elastomer polymer, said polymer comprising 14 parts by weight of said matrix;

chlorinated paraffin extender resin, said resin comprising 8 parts by weight of said matrix;

chlorinated alpha-olefin plasticizer, said plasticizer comprising 3.5 parts by weight of said matrix;

stearic acid rubber stock, said stearic acid comprising 0.5 part by weight of said matrix;

solid glass spheres, said spheres having a mean diameter of approximately 115 microns and comprising 41 parts by weight of said matrix;

amorphous precipitated hydrated silica, said silica comprising 2 parts by eight of said matrix; and hydrated alumina, said alumina having a mean diameter of less than one micron and a GE brightness of at least 94, said alumina comprising 31 parts by weight of said matrix.

* * * * *

UNITED STATES PATENT AND TRADEMARK OFFICE

CERTIFICATE OF CORRECTION

PATENT NO. : 5,374,465

DATED : December 20, 1994

INVENTOR(S) : Robert D. Fulcomer

It is certified that error appears in the above-indentified patent and that said Letters Patent is hereby corrected as shown below:

Column 1, line 34, "Unless; the" should read --Unless the--.

Column 6, line 23, "13 to 13 parts" should read --13 to 15 parts--.

Column 6, line 47, "resin halogenated" should read --resin, halogenated--.

Column 8, line 16, "2 parts by eight" should read --2 parts by weight--.

Signed and Sealed this

Twenty-ninth Day of August, 1995

Bruce Lehman

*Attest:*

BRUCE LEHMAN

*Attesting Officer*

*Commissioner of Patents and Trademarks*